US006138459A

United States Patent [19]

Yatsuzuka et al.

[11] Patent Number: 6,138,459

[45] Date of Patent: Oct. 31, 2000

[54] LINEAR COMPRESSOR FOR REGENERATIVE REFRIGERATOR

[75] Inventors: Shinichi Yatsuzuka; Yasumasa Hagiwara, both of Kariya, Japan

[73] Assignee: Advanced Mobile Telecommunication Technology Inc., Nisshin, Japan

[21] Appl. No.: 09/266,808

[22] Filed: Mar. 12, 1999

[30] Foreign Application Priority Data

Feb. 5, 1999 [JP] Japan ..... 11-029040

[51] Int. Cl.[7] ..... F25B 9/00

[52] U.S. Cl. ..... 62/6

[58] Field of Search ..... 62/6

[56] References Cited

U.S. PATENT DOCUMENTS 4,872,313 10/1989 Kazumoto et al. ..... 62/6
5,040,372 8/1991 Higham ..... 62/6
5,255,521 10/1993 Watanabe ..... 62/6
5,647,217 7/1997 Penswick et al. ..... 62/6
5,701,743 12/1997 Hagiwara et al. ..... 62/6

*Primary Examiner*—William Doerrler
*Attorney, Agent, or Firm*—Pillsbury Madison & Sutro LLP

[57] ABSTRACT

The linear compressor for compressing and expanding working fluid contained in a regenerative refrigerator is composed of a compressor casing in which a pair of pistons are disposed and a plurality of electromagnets for driving the pair of pistons. A pair of rods for driving the pair of pistons are also disposed in the compressor casing, and permanent magnets are mounted on the driving rods. The plurality of electromagnets are disposed outside of the compressor casing along the axis of the driving rods so that the electromagnets face the permanent magnets. The pair of driving rods are driven by magnetic force between the permanent magnets and the electromagnets which are excited by alternating current. The linear compressor can be made small in size and heat generated in the electromagnets can be easily dissipated, because the electromagnets are disposed outside of the compressor casing.

7 Claims, 6 Drawing Sheets

LINEAR COMPRESSOR FOR REGENERATIVE REFRIGERATOR

CROSS-REFERENCE TO RELATED APPLICATION

This application is based upon and claims benefit of priority of Japanese Patent Application No. Hei-11-29040 filed on Feb. 5, 1999, the content of which is incorporated herein by reference.

BACKGROUND OF THE INVENTION

1. Field of the Invention

The present invention relates to a linear compressor for a regenerative refrigerator, such as a pulse tube refrigerator or a Stirling refrigerator, which cools objects by compressing and expanding working fluid contained in its regenerator.

2. Description of Related Art

A star-shaped linear compressor for a regenerative refrigerator is known hitherto. The linear compressor includes a plurality of electromagnets arranged radially around a driving shaft in which permanent magnets are embedded. Since all the components including the plurality of electromagnets are contained in a compressor casing in the conventional compressor, it is unavoidable to make the size and weight of the compressor casing large when larger electromagnets are required to enhance a driving force of the compressor. Further, heat of the electromagnets is not sufficiently dissipated because they are contained in the compressor casing.

SUMMARY OF THE INVENTION

The present invention has been made in view of the above-mentioned problems, and an object of the present invention is to provide a linear compressor for a regenerative refrigerator, the linear compressor being small in size and its heat dissipation being improved.

The linear compressor of the present invention is used for compressing and expanding working fluid for a regenerative refrigerator such as a pulse tube or a Stirling refrigerator. The linear compressor includes a compressor casing in which the working fluid is compressed and expanded and a second magnetic field generating means disposed outside of the compressor casing for driving the compressor. The compressor casing is composed of a cylinder portion in which a pair of pistons are disposed movably in their axial direction, a pair of side portions connected to the cylinder portion, each side portion containing therein a rod for driving the piston, and case portions for containing therein members for movably supporting the driving rods. All these portions of the compressor casing are formed as a hermetically enclosed single vessel.

A first magnetic field generating means, preferably permanent magnets, is mounted on the driving rod. A plurality of the second magnetic field generating means, preferably electromagnets, are disposed laterally along the axis of the driving rods so that they face the first magnetic field generating means with a small gap therebetween. The driving rods are movably supported in the compressor casing by supporting members. The pair of the pistons are driven back and forth in the cylinder portion by magnetic force between the first and the second magnetic field generating means. When the first magnetic field generating means is composed of permanent magnets and the second magnetic field generating means is composed of electromagnets, alternating current is supplied to the second magnetic field generating means to drive the pistons. It is possible to use permanent magnets as the second magnetic field generating means and electromagnets as the first magnetic field generating means. In this case, alternating current is supplied to the first magnetic field generating means to drive the pistons.

The members for movably supporting the driving rod are disposed in the cases formed integrally with the compressor casing. Preferably, the supporting members are formed by laminating a plurality of elongate leaf springs and disposed in a round tube-shaped case to minimize the case size.

Since the second magnetic field generating means is disposed outside of the compressor casing along the longitudinal direction of the driving rod, the number of the second magnetic field generating means can be easily increased according to required force for driving the pistons without enlarging a radial size and/or a wall thickness of the compressor casing. The linear compressor having the structure according to the present invention can be made compact in size. Moreover, heat generated in the electromagnets can be easily dissipated because they are positioned outside the compressor casing.

Other objects and features of the present invention will become more readily apparent from a better understanding of the preferred embodiments described below with reference to the following drawings.

DETAILED DESCRIPTION OF THE PREFERRED EMBODIMENTS

Figure 1:
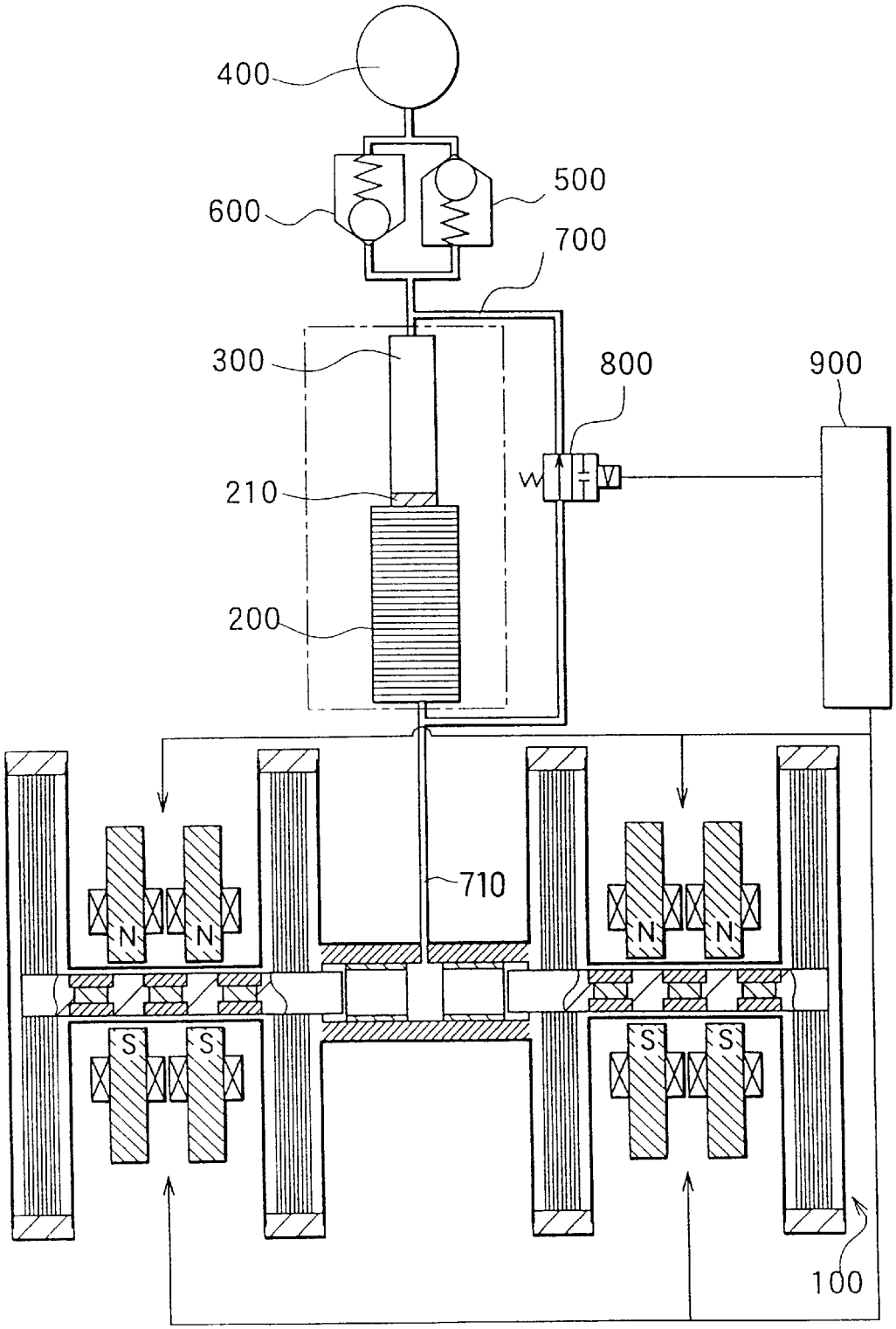
FIG. 1 is a schematic cross-sectional view showing a pulse tube refrigerator to which a linear compressor of the present invention is connected.

A first embodiment of the present invention will be described with reference to FIGS. 1–5. FIG. 1 schematically shows a whole pulse tube refrigerator system to which a linear compressor of the present invention is connected. Since the structure and operation of the pulse tube refrigerator is shown in Japanese Patent No. 2699957, details thereof will not be described herein.

Referring to FIG. 1, the pulse tube refrigerator system is composed of: a linear compressor 100 for compressing and expanding working fluid in the system; a regenerator 200 containing working fluid such as helium (He), nitrogen ($N_2$), hydrogen ($H_2$), argon (Ar) or neon (Ne), which is compressed and expanded to generate static and progressive waves in the regenerator by operation of the linear compressor 100; a cool end portion 210 on which objects to be cooled, such as a superconductor or an infrared sensor, are mounted; a pulse tube 300 contacting the cool end portion 210 and communicating with a inner space of the regenerator 200; a relief valve including a first relief valve 500 and a second relief valve 600; a buffer tank 400 connected to the pulse tube 300 through the relief valve; a double inlet pipe 700 connecting a bottom end of the regenerator 200 and an upper end of the pulse tube 300; an electromagnetic valve 800 disposed in the passage of the double inlet pipe 700; and a controller 900 for controlling operation of the linear compressor 100 and the electromagnetic valve 800.

The regenerator 200 absorbs heat from the working fluid flowing therethrough when the working fluid is compressed, and transfers the absorbed heat to the working fluid when the working fluid is expanded. Since such heat absorbing and transferring have to be done quickly, the regenerator 200 has a sufficiently high heat capacity compared with that of the working fluid. The regenerator 200 is formed by stacking metallic meshed-plates made of a material having a high heat conductivity such as stainless steel, copper or copper alloy. The meshed-plates are stacked preferably in a longitudinal direction of the regenerator 200 to suppress heat conduction from the linear compressor 100 to the cool end portion 210 through the regenerator 200. A hermetically enclosed vessel containing metallic balls made of stainless steel or lead may be used as the regenerator 200.

The cool end portion 210 mounted on the upper end of the regenerator 200 is made of a material having a high heat conductivity such as copper or indium, and cools down objects directly contacting the cool end portion 210. The pulse tube 300 communicating with the inside space of the regenerator 200 is a thin pipe made of a material such as stainless steel, titanium or titanium alloy. The buffer tank 400 temporarily stores the working fluid displaced from the pulse tube 300 connected through the relief valve. The first relief valve 500 prevents the working fluid from entering the buffer 400, and allows the working fluid to flow out from the buffer tank 400 when there exists a predetermined pressure difference between the buffer tank 400 and the pulse tube 300. The second relief valve 600 prevents the working fluid from flowing out from the buffer tank 400, and allows the working fluid to flow into the buffer tank 400 when there exists a predetermined pressure difference between the buffer tank 400 and the pulse tube 300.

All of the components of refrigerator system, that is, the linear compressor 100, the regenerator 200, the cool end portion 210, the pulse tube 300, the relief valves 500, 600, and the buffer tank 400 are positioned in series in the direction of the working fluid displacement. The regenerator 200, the cool end portion 210 and the pulse tube 300 (components encircled with a dotted line in FIG. 1) are contained in a vacuum container to intercept heat transfer between those components and the atmosphere.

The upper end of the pulse tube 300 and the bottom end of the regenerator 200 are connected through the double inlet pipe 700 with the electromagnetic valve 800 interposed therebetween. The working fluid pressurized in the linear compressor 100 enters the pulse tube 300 from its upper end, and the working fluid flow is intercepted by the electromagnetic valve 800 according to a signal from the controller 900.

The structure of the linear compressor 100 will be described with reference to FIGS. 2A, 2B, 3 and 4. The linear compressor 100 is connected to the bottom end of the regenerator 200 through a conduit 710. The linear compressor 100 is structured symmetrically with respect to the conduit 710. A compressor casing 110 made of stainless steel includes a center portion in which pistons 121 are slidably disposed, side portions in which plungers 123 are disposed and pipe-shaped spring cases 160. All of these portions are formed as a single body. A pair of driving rods 120 each having a piston 121 and a plunger 123 are disposed in the compressor casing 110. A spring member 151 disposed in the spring case 160 of the compressor casing 110 movably supports the plunger 123 in the compressor casing 110. Each plunger 123 is supported by a pair of spring members 151.

The piston 121 connected to the plunger 123 is disposed in the center portion of the compressor casing 110 with a small gap therebetween, so that the piston 121 is movable in the longitudinal direction of the driving rod 120. The working fluid is compressed and expanded in a space between both pistons 121. The center portion of the compressor casing 110 where the pistons 121 are disposed will be referred to as a cylinder. The cylinder is made of a material having the same linear expansion coefficient as that of the piston 121. The plunger 123 connected to the piston 121 by a screw carries plate-shaped permanent magnets 122 embedded therein. Three permanent magnets 122 are embedded in each plunger 123 in this embodiment. A pair of yokes 124 made of a magnetic material for enhancing a magnetic flux density of the permanent magnet 122 are attached to both sides (an N pole and an S pole) thereof. The piston 121 and the plunger 123 are made of a nonmagnetic material such as aluminum. The magnetic material of the yokes 124 is an iron-based material having a low carbon content.

Figure 2B:
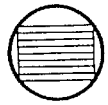
FIG. 2B is a cross-sectional view showing a leaf spring disposed in a cylindrical case, taken along a line IIB—IIB in FIG. 2A.
Figure 2A:
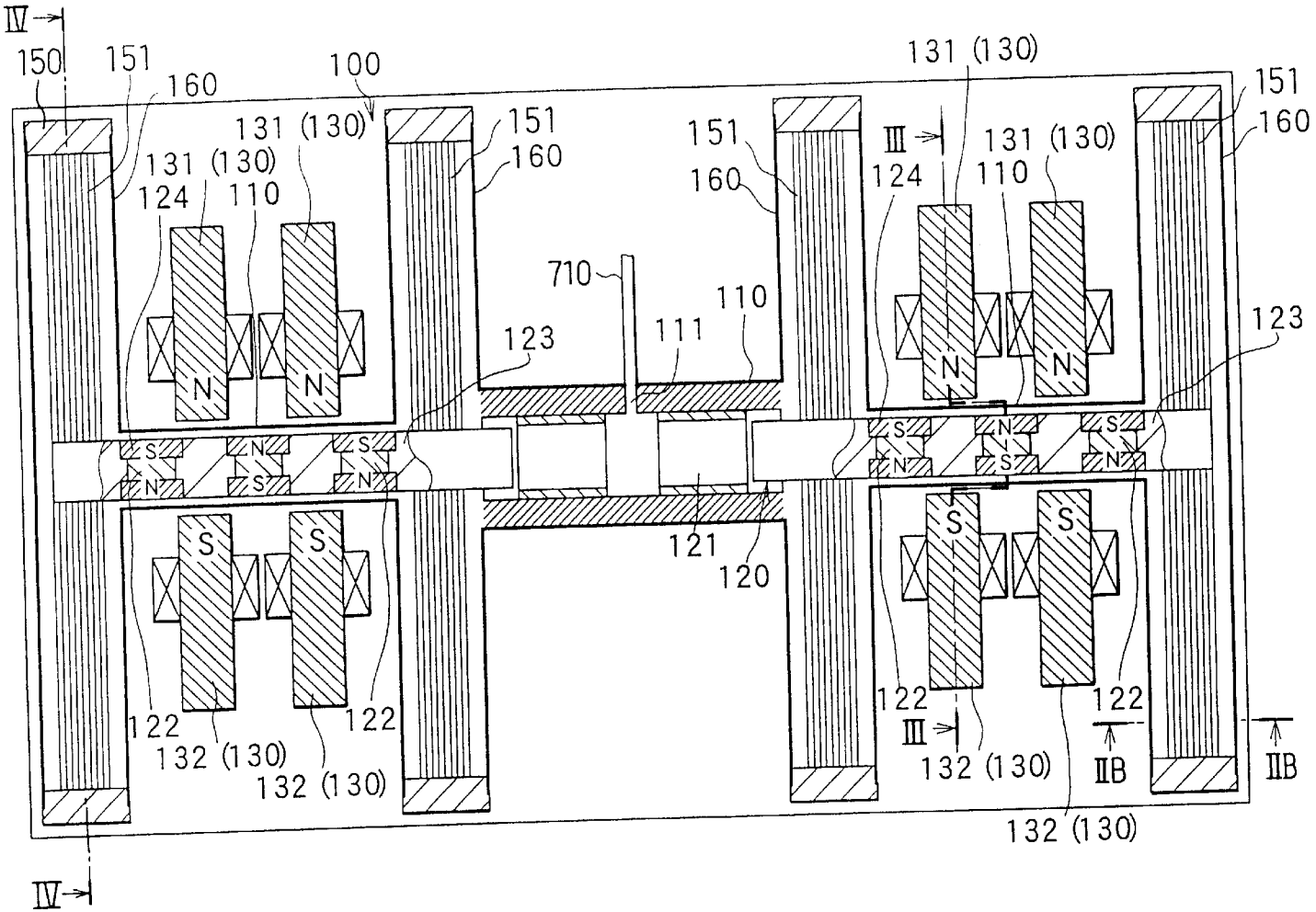
FIG. 2A is a cross-sectional view showing the linear compressor shown in FIG. 1.
Figure 3:
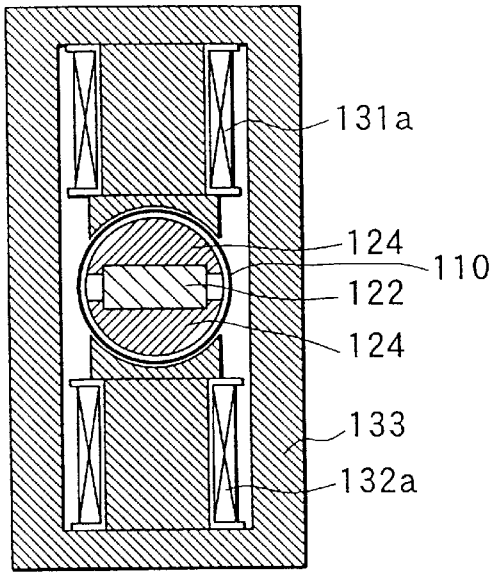
FIG. 3 is a cross-sectional view showing a pair of electromagnets and a plunger, as a first embodiment, taken along a line III—III in FIG. 2A.

A pair of electromagnets 130 consisting of a first electromagnet 131 and a second electromagnet 132 are fixedly disposed outside of the side portion of the compressor casing 110 with a small gap therebetween. Two pairs of electromagnets 130 are laterally disposed along each plunger 123 in this particular embodiment. In other words, four pairs of electromagnets 130 are used in total in this embodiment as shown in FIG. 2A. Details of the permanent magnet 122 and the electromagnet 130 are shown in FIG. 3 as a cross-sectional view thereof. A first electromagnetic coil 131*a* is wound around a core attached to a yoke 133 to generate magnetic flux through the yoke. Similarly, a second electromagnetic coil 132*a* is wound around a core attached to a yoke 133. The yoke 133 including the cores is formed by laminating steel plates or silicon steel plates to suppress eddy current therein.

Figure 4:
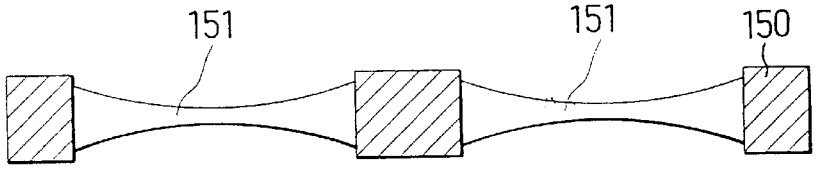
FIG. 4 is a cross-sectional view showing the leaf spring, taken along a line IV—IV in FIG. 2A.

A pair of driving rods 120, each having the piston 121 and the plunger 123, are supported in the compressor casing 110. The plunger 123 is supported in the side portion of the compressor casing 110 by two spring members 151 connected to both ends of the plunger 123. The spring member 151 is contained and supported in the spring case 160 so that the plunger 123 does not contact the spring case wall when it moves back and forth in the longitudinal direction of the driving rod 120. The spring case 160 is made of stainless steed and pipe-shaped as shown in FIG. 2B. As shown in FIG. 4, the spring member 151 is made by laminating plural leaf springs and is connected to the plunger 123 at its one end and to a supporter 150 fixed to the spring case 160 at its the other end. FIG. 4 shows the shape of spring member 151, viewed from the longitudinal end of the plunger 123. Each leaf spring connected to the plunger 123 and the supporter 150 is narrowed at its center portion as shown in FIG. 4, so that its maximum stress becomes substantially equal throughout its whole length.

The piston 121 is disposed in the cylinder of the compressor case 110 with a small gap therebetween without using a seal member such as a piston ring. Therefore, the pressure in the cylinder is transferred to an entire inner space of the compressor casing 110 including the spring case 160. Though the piston 121 is disposed in the cylinder so that it moves without contacting the cylinder wall, the piston 121 may contact the cylinder wall when the driving rod 120 vibrates due to vibration given from the outside. To protect the cylinder wall and the piston 121, the outer periphery of the piston 121 is coated with resin.

Figure 5:
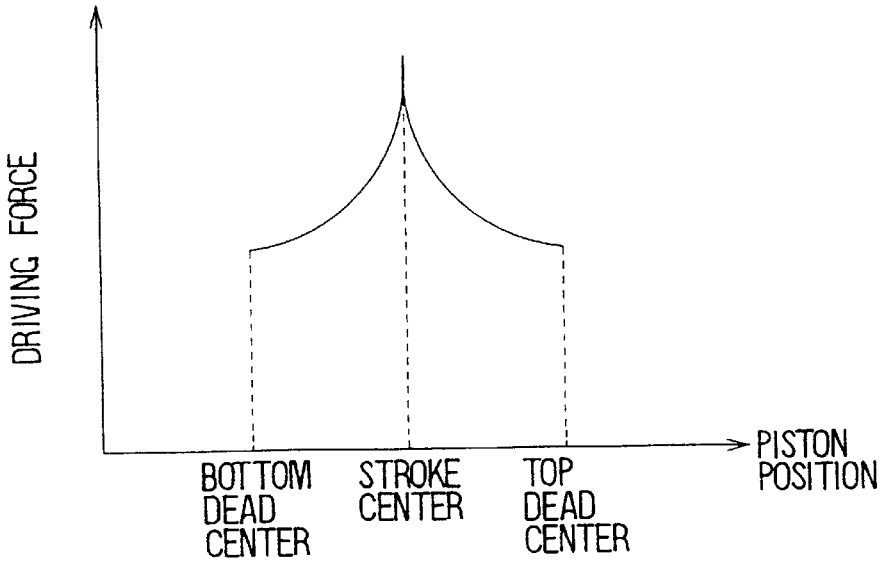
FIG. 5 is a graph showing a relation between positions of a piston and its driving force.

The driving rod 120 is driven in its longitudinal direction by electromagnetic force between the permanent magnets 122 and the electromagnets 130. The electromagnets 130 is controlled by the controller 900 so that their polarities alternate with a frequency which is the same as a natural frequency of a vibration system including the driving rod 120, the spring member 151 and an elasticity characteristic of the working fluid. In other words, the driving rod 120 is driven by attractive and repulsive forces between the permanent magnets 122 and the electromagnets 130. As shown in FIG. 5, the permanent magnets 122 and the electromagnets 130 are arranged so that the driving force becomes maximum when the piston takes its position at its stroke center (a mid position between a top dead center and a bottom dead center). In other words, a gradient of permeance between the permanent magnets 122 and the electromagnets 130 becomes maximum at the stroke center.

Features and advantages of the first embodiment of the present invention will be summarized as follows. Since a plurality of electromagnet pairs 130 are disposed outside of each side portion of the compressor casing 110 and aligned along its longitudinal direction, the number of electromagnet pairs can be increased without enlarging the radial size and wall thickness of the compressor casing 110. Accordingly, the linear compressor 100 is made compact in size and light in weight, compared with a conventional linear compressor in which the electromagnets are disposed inside the compressor casing 110. Moreover, its heat dissipation characteristic can be improved.

Since the spring member 151 for supporting the driving rod 120 is disposed in the round pipe spring case 160, the spring case 160 can be made small and compact. Since the driving force of the driving rod 120 is designed so that it becomes maximum at the stroke center of the piston 121 where a resiliency resistance of the working fluid becomes maximum, the linear compressor 100 is operated with a high efficiency. Since the first electromagnet 131 and the second electromagnet 132, both constituting the electromagnet 130, are disposed with the plunger 123 interposed therebetween, only two magnetic gaps are formed in the magnetic flux path, thereby preventing the magnetic resistance from becoming excessively high. Since the driving rod 120 is movably supported by the spring members 151 contained in the tube-shaped spring cases 160 disposed at both ends of the driving rods 120, the linear compressor 100 can be made smaller in size, compared with a compressor in which the moving rod is supported by disc-shaped supporting members such as disc springs.

Figure 6:
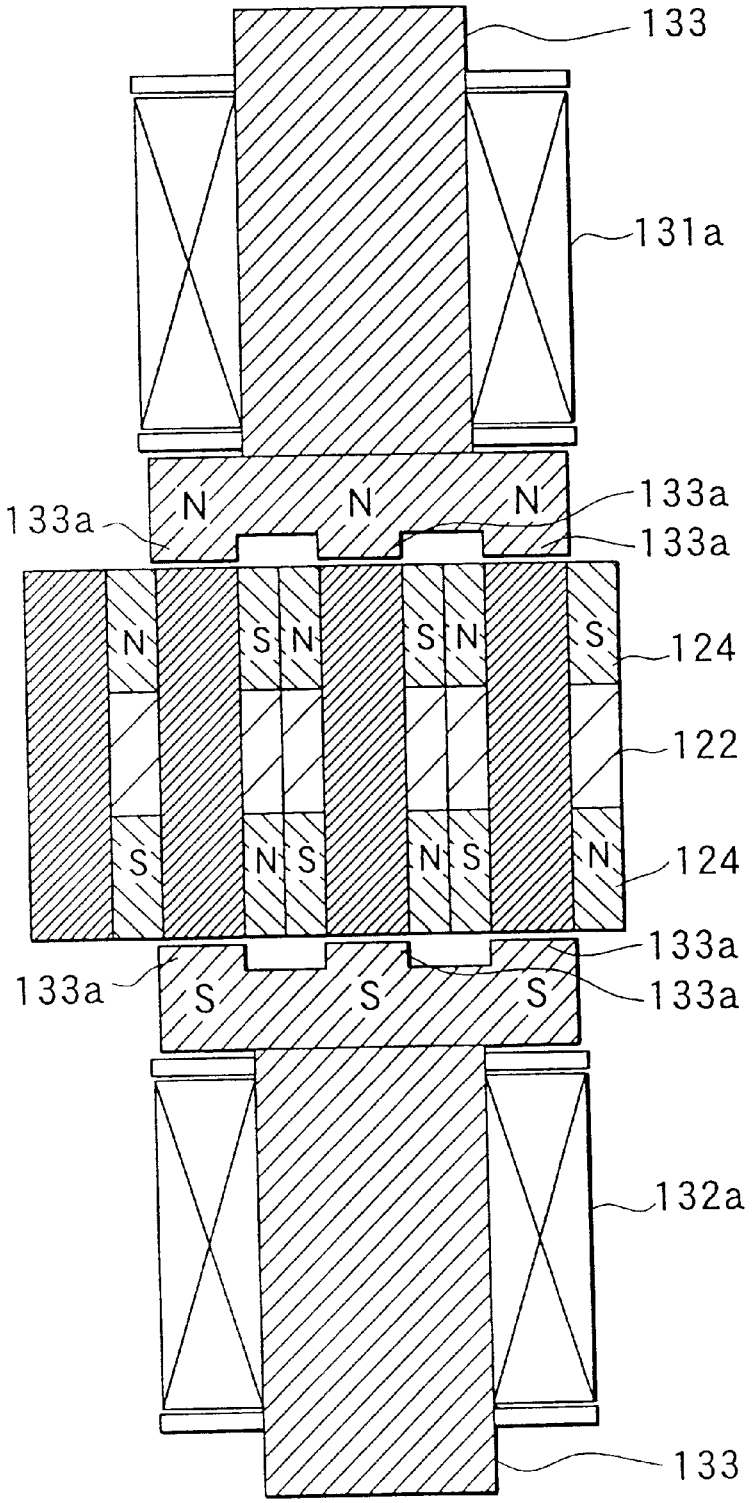
FIG. 6 is a cross-sectional view showing a pair of electromagnets and a plunger, as a second embodiment.

A second embodiment of the present invention is shown in FIG. 6 which shows a cross-sectional view similar to FIG. 3. The second embodiment is designed in consideration of the fact that the driving force increases in proportion to a gradient of permeance change in a magnetic flux path. On a pole piece portion of the yoke 133 of the electromagnet 130, which faces the permanent magnets 122 embedded in the plunger 123, projections 133*a* are formed. The gradient of the permeance change is made higher by the projections 133*a,* and accordingly the driving force of the driving rod 120 is enhanced.

Figure 7:
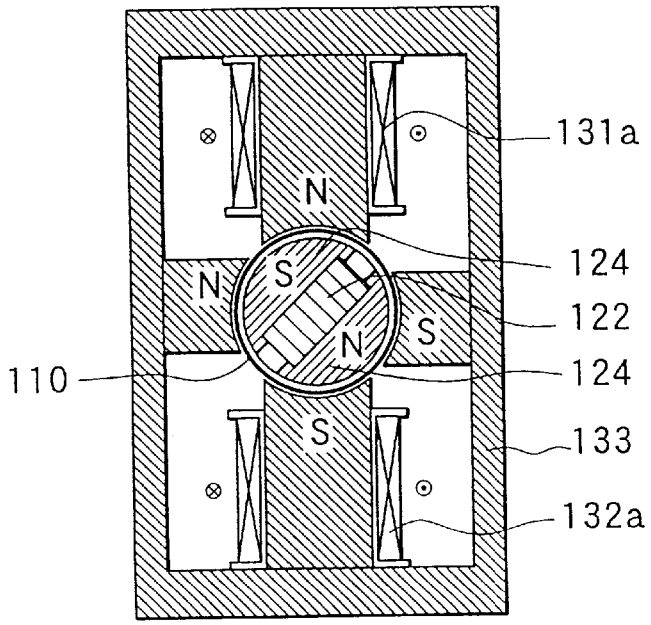
FIG. 7 is a cross-sectional view showing a pair of electromagnets and a plunger, as a third embodiment.

A third embodiment of the present invention is shown in FIG. 7 which shows a cross-sectional view similar to FIG. 3. Additional pole piece portions which face the permanent magnets 122 are added to the yoke 133 to increase the driving force. Four pole piece portions of the yoke 133 are disposed with ninety-degree intervals among them with respect to the center of the driving rod 120. To avoid magnetic force imbalance between poles of the permanent magnets 122 and the electromagnet 130, the plunger 123 carrying permanent magnets thereon is positioned with an angle rotated counter-clockwise by 45 degrees from the position in the first and second embodiments.

Figure 8:
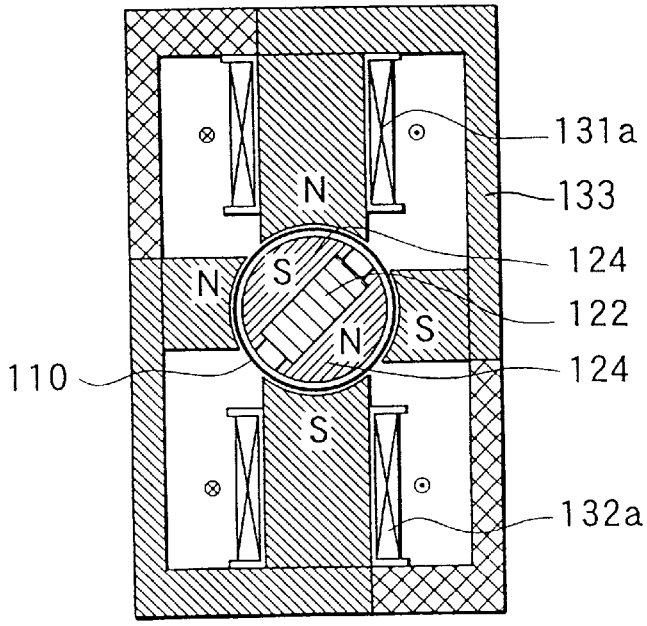
FIG. 8 is a cross-sectional view showing a pair of electromagnets and a plunger, as a fourth embodiment.

A fourth embodiment of the present invention is shown in FIG. 8 which is similar to FIG. 7. In this embodiment, only the yoke 133 is structured differently from that of the third embodiment. Cross-hatched portions (mesh-hatched portions) of the yoke 133 are made of a non-magnetic material, while the other portions (hatched portions) are made of a magnetic material, in order to make it sure that magnetic polarities (N and S) of the pole piece portions facing the permanent magnets 122 are appropriate. That is, polarities of the pole piece portions facing the permanent magnets have to be alternate as shown in FIG. 8. However, there is a possibility that the polarities of the additional pole piece portions become the same, if the magnetic flux generated by the first and second electromagnetic coils 131*a,* 132*a* flows symmetrically with respect to their axes. To avoid this possibility, the yoke 133 is structured asymmetrically to intercept the magnetic flux flow by the cross-hatched portions made of a non-magnetic material. Thus, polarities of the pole piece portions become alternate around the permanent magnets without fail, and thereby a higher driving force is obtained.

Figure 9:
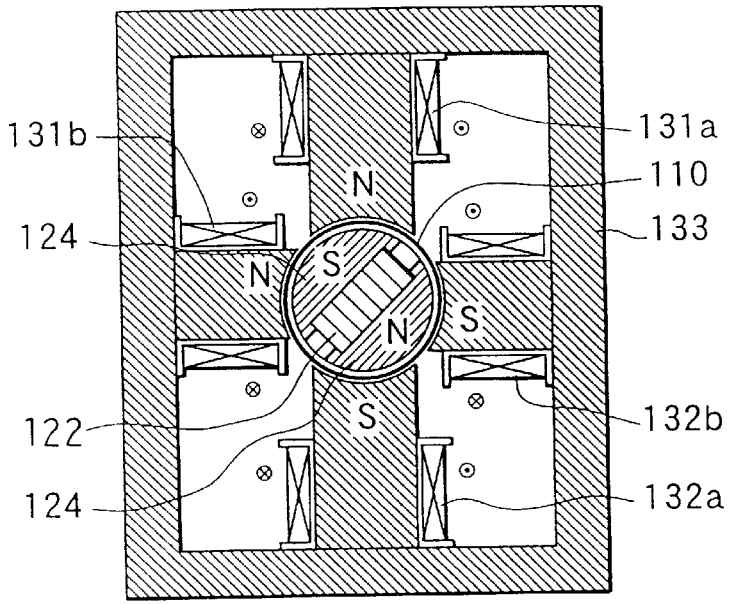
FIG. 9 is a cross-sectional view showing two pairs of electromagnets and a plunger, as a fifth embodiment.

A fifth embodiment of the present invention is shown in FIG. 9 which shows a cross-sectional view similar to that in FIG. 3. However, in this embodiment, the yoke 133 includes four portions for winding the electromagnetic coil thereon arranged with 90-degree intervals from each other. That is, the first electromagnet 131 has two coils 131*a* and 131*b,* and the second electromagnet 132 has tow coils 132*a* and 132*b.* Exciting current for these coils flows in the directions shown in FIG. 9 with marks (⊙ and ⊗). This arrangement makes sure that all the pole piece portions of the electromagnet 130 are disposed around the permanent magnet 122 with alternate polarities and that the driving force is further enhanced.

Figure 10:
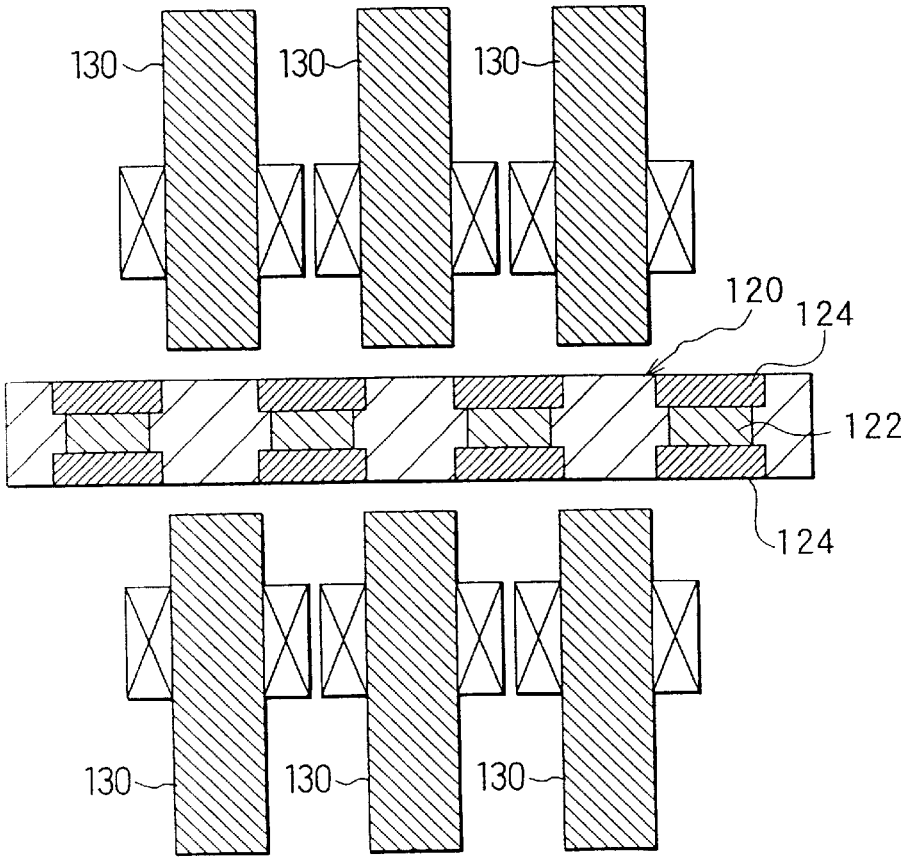
FIG. 10 is a cross-sectional view showing three pairs of electromagnets and a plunger, as a modified form of the present invention.

The present invention is not limited to the embodiments described above, but may be modified in various ways. For example, three pairs of the electromagnet 130 may be used for each driving rod 120 as shown in FIG. 10. The number of electromagnet pairs may be arbitrarily increased according to required driving force. Though the present invention is described in conjunction with a pulse tube refrigerator, it may be applied to other refrigerators such as a Stirling refrigerator. Though the compressor case 110 having round tube spring cases 160 is disclosed as an example, it may be modified in different shapes. The permanent magents 122 embedded in the plunger 123 may be replaced with electromagnets energized by alternating current. In this case, the electromagnets 130 are energized by direct current, or they are replaced with permanent magnets. It is also possible to use electromagnets energized by alternating current as both stationary and moving magnetic flux sources. In this case, phases of alternating current for both electromagnets are shifted from each other.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A linear compressor for a regenerative refrigerator in which working fluid is compressed and expanded to generate refrigeration temperature, the linear compressor comprising:

a compressor casing having a cylinder communicating with the regenerative refrigerator;

a pair of pistons disposed in the cylinder for compressing and expanding the working fluid therein;

a driving rod connected to each piston for driving the same and disposed in the compressor casing;

first magnetic field generating means mounted on the driving rod; and a plurality of second magnetic field generating means fixedly positioned outside the compressor casing to face the first magnetic field generating means with a small gap therebetween, the plurality of the second field generating means being disposed laterally with one another along an axis of the driving rod, wherein:

at least one of magnetic fields generated by the first and the second magnetic field generating means is a periodically alternating magnetic field; and the driving rod is driven back and forth in its axial direction by magnetic force between the magnetic fields generated by the first and the second magnetic field generating means.

2. The linear compressor as in claim 1, wherein:

the first magnetic field generating means includes permanent magnets; and the second magnetic field generating means includes electromagnets excited by alternating current.

3. The linear compressor as in claim 1, wherein the compressor casing is round pipe-shaped.

4. A linear compressor for a regenerative refrigerator in which working fluid is compressed and expanded to generate refrigeration temperature, the linear compressor comprising:

a compressor casing including a cylinder communicating with the regenerative and a pipe-shaped case communicating with the cylinder, the pipe-shaped case being disposed perpendicularly to the cylinder, the compressor casing being formed as a single pressure vessel;

a pair of pistons disposed in the cylinder for compressing and expanding the working fluid therein;

a driving rod connected to each piston for driving the same and disposed in the compressor casing; and a member for movably supporting the driving rod in the compressor casing, the supporting member being contained in the pipe-shaped case.

5. A linear compressor for a regenerative refrigerator in which working fluid is compressed and expanded to generate refrigeration temperature, the linear compressor comprising:

a compressor casing having a cylinder communicating with the regenerative refrigerator;

a pair of pistons disposed in the cylinder for compressing and expanding the working fluid therein;

a driving rod connected to each piston for driving the same and disposed in the compressor casing;

permanent magnets mounted on the driving rod; and a plurality of electromagnets fixedly positioned outside the compressor casing to face the permanent magnets with a small gap therebetween, the plurality of the electromagnets being disposed laterally with one another along an axis of the driving rod and being excited by alternating current to drive the driving rod back and forth in its axial direction by magnetic force between the magnetic fields of the plurality of electromagnets and the permanent magnets mounted on the driving rod.

6. The linear compressor as in claim 5, wherein:

each of the plurality of the electromagnets includes an electromagnetic coil and a yoke for providing a magnetic flux path; and a plurality of projections are formed on a portion of the yoke which faces the permanent magnets mounted on the driving rod.

7. The linear compressor as in claim 4, wherein:

the supporting member is composed of a plurality of leaf springs laminated on one another.

* * * * *